US005476404A

United States Patent [19]

Price

[11] Patent Number: 5,476,404

[45] Date of Patent: Dec. 19, 1995

[54] INFLATABLE RECREATIONAL INNER TUBE TOY

[76] Inventor: John B. Price, 16040 150th, Bonner Springs, Kans. 66012

[21] Appl. No.: 324,795

[22] Filed: Oct. 18, 1994

[51] Int. Cl.[6] ..... A63H 3/06; A63H 23/00; B63B 1/00; B63C 9/30

[52] U.S. Cl. ..... 446/221; 446/153; 441/67; 441/126; 441/131; 472/129; 472/134

[58] Field of Search ..... 446/29, 71, 72, 446/73, 153, 220, 221, 222, 223, 225, 226; 441/66, 67, 126, 129, 130, 131, 132; 472/128, 129, 134; 5/644

[56] References Cited

U.S. PATENT DOCUMENTS

| | | | |
|---|---|---|---|
| 3,860,976 | 1/1975 | Suyama | 446/67 X |
| 4,302,003 | 11/1981 | Hughes | 472/129 |
| 4,687,452 | 8/1987 | Hull | 441/131 |
| 5,004,296 | 4/1991 | Ziegenfuss, Jr. | 441/132 X |
| 5,090,930 | 2/1992 | Walden | 441/131 |
| 5,122,086 | 6/1992 | Remy | 441/129 X |
| 5,186,667 | 2/1993 | Wang | 441/130 X |

*Primary Examiner*—Robert A. Hafer
*Assistant Examiner*—D. Neal Muir

[57] ABSTRACT

An inflatable recreational inner tube toy comprising a seat further including a toroid-shaped inflatable primary tube having a bottom surface, a top surface, an inner periphery defining a hollow interior, an outer periphery, a plurality of straps extended across the interior and coupled to the inner periphery, a generally-inflatable leg rest integrally coupled to and extended outwards from the outer periphery of the primary tube, and a valve for allowing the seat to be inflated and deflated; and a back rest formed of a toroid-shaped inflatable secondary tube sized smaller than the primary tube with the back rest coupled to the inner periphery of the primary tube and extended upwards therefrom and with the back rest further including a valve coupled thereto for allowing it to be inflated and deflated.

1 Claim, 3 Drawing Sheets

FIG 1
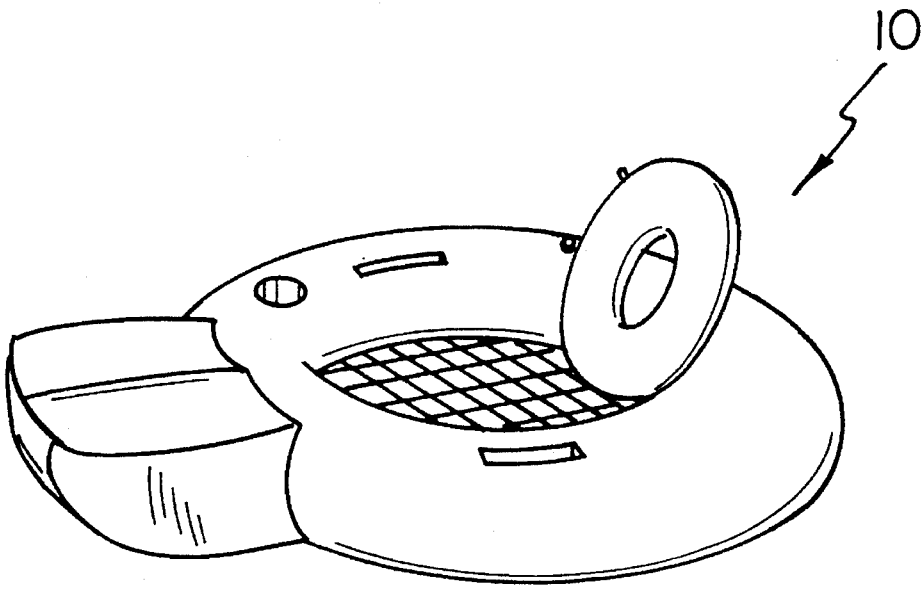
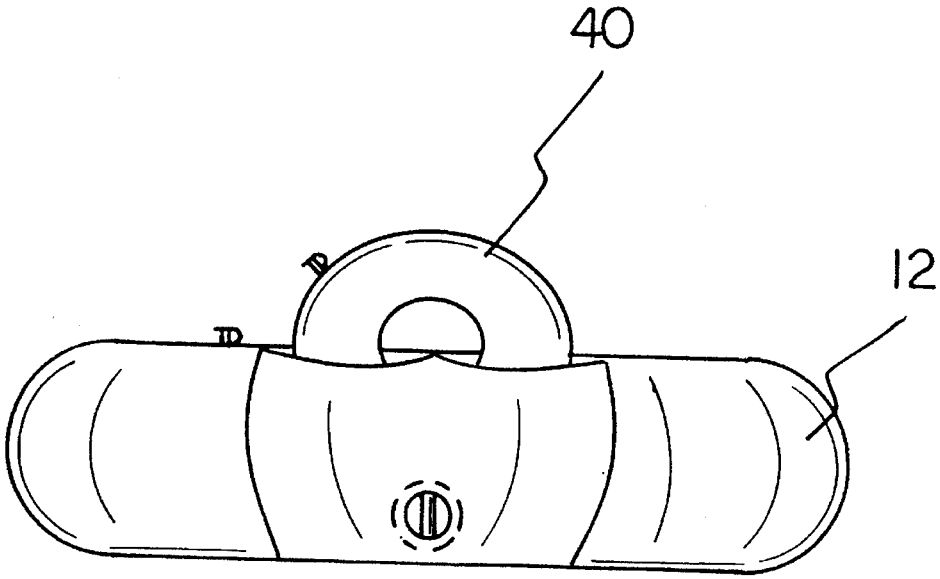
FIG 2

INFLATABLE RECREATIONAL INNER TUBE TOY

BACKGROUND OF THE INVENTION

1. Field of the Invention

The present invention relates to an inflatable recreational inner tube toy and more particularly pertains to use in recreational activities with an inflatable recreational inner tube toy.

2. Description of the Prior Art

The use of inner tube apparatuses is known in the prior art. More specifically, inner tube apparatuses heretofore devised and utilized for the purpose of use in recreational activities are known to consist basically of familiar, expected and obvious structural configurations, notwithstanding the myriad of designs encompassed by the crowded prior art which have been developed for the fulfillment of countless objectives and requirements.

By way of example, U. S. Pat. No. 3,928,879 to Britschinn discloses inflatable tube bodies. U. S. Pat. No. 4,367,689 to Lukehart et al. discloses a water recreational vehicle. U. S. Pat. No. 4,795,387 to Morgan discloses a collapsible inner tube seat insert. U. S. Pat. No. 5,046,978 to Howerton discloses a float tube with adjustable sling seat. U. S. Pat. No. 5,122,086 to Remy discloses a towable riding apparatus. U. S. Pat. No. 5,224,891 to Stephens discloses a recreational insert for an inner tube.

While these devices fulfill their respective, particular objective and requirements, the aforementioned patents do not describe an inflatable recreational inner tube toy that can be used in a variety of recreational activities such as sleding or skiing.

In this respect, the inflatable recreational inner tube toy according to the present invention substantially departs from the conventional concepts and designs of the prior art, and in doing so provides an apparatus primarily developed for the purpose of use in recreational activities.

Therefore, it can be appreciated that there exists a continuing need for new and improved inflatable recreational inner tube toy which can be used for use in recreational activities. In this regard, the present invention substantially fulfills this need.

SUMMARY OF THE INVENTION

In the view of the foregoing disadvantages inherent in the known types of inner tube apparatuses now present in the prior art, the present invention provides an improved inflatable recreational inner tube toy. As such, the general purpose of the present invention, which will be described subsequently in greater detail, is to provide a new and improved inflatable recreational inner tube toy and method which has all the advantages of the prior art and none of the disadvantages.

To attain this, the present invention essentially comprises, in combination a seat. The seat includes a toroid-shaped inflatable rubber primary tube having a bottom surface, a top surface, an inner periphery defining a hollow interior, an outer periphery, a pair of diametrically opposed sunken handles integrally coupled to the top surface, a cup holder formed as a recess integrally coupled to the top surface, a plurality of nylon straps extended across the interior and coupled to the inner periphery at a location near the bottom surface, a generally duckbill-shaped inflatable rubber leg rest integrally coupled to and extended outwards from the outer periphery of the primary tube with the leg rest including an eye hook formed thereon for allowing attachment of an external pull rope, and a valve coupled to the primary tube for allowing the seat to be inflated and deflated. A back rest is also included and formed of a toroid-shaped inflatable rubber secondary tube sized smaller than the primary tube. The back rest is coupled to the inner periphery of the primary tube and extended angularly upwards therefrom. The back rest also has a valve coupled thereto for allowing it to be inflated and deflated.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, iris to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved inflatable recreational inner tube toy which has all the advantages of the prior art inner tube apparatuses and none of the disadvantages.

It is another object of the present invention to provide a new and improved inflatable recreational inner tube toy which may be easily and efficiently manufactured and marketed.

It is a further object of the present invention to provide a new and improved inflatable recreational inner tube toy which is of durable and reliable construction.

An even further object of the present invention is to provide a new and improved inflatable recreational inner tube toy which is susceptible of a low cost of manufacture with regard to both materials and labor, and which accordingly is then susceptible of low prices of sale to the consuming public, thereby making such an inflatable recreational inner tube toy economically available to the buying public.

Still yet another object of the present invention is to provide a new and improved inflatable recreational inner tube toy which provides in the apparatuses and methods of the prior art some of the advantages thereof, while simultaneously overcoming some of the disadvantages normally associated therewith.

Even still another object of the present invention is to provide a new and improved inflatable recreational inner tube toy for use in recreational activities.

Lastly, it is an object of the present invention to provide a new and improved inflatable recreational inner tube toy comprising a seat further comprising a toroid-shaped inflatable primary tube having a bottom surface, a top surface, an inner periphery defining a hollow interior, an outer periphery, a plurality of straps extended across the interior and coupled to the inner periphery, a generally inflatable leg rest integrally coupled to and extended outwards from the outer periphery of the primary tube, and a valve for allowing the seat to be inflated and deflated; and a back rest formed of a toroid-shaped inflatable secondary tube sized smaller than the primary tube with the back rest coupled to the inner periphery of the primary tube and extended upwards therefrom, the back rest further including a valve coupled thereto for allowing it to be inflated and deflated.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the inflatable recreational inner tube toy constructed in accordance with the principles of the present invention.

FIG. 2 is a side-elevational view of the present invention as viewed with respect to its leg rest.

The same reference numerals refer to the same parts through the various Figures.

DESCRIPTION OF THE PREFERRED EMBODIMENT

Figure 3:
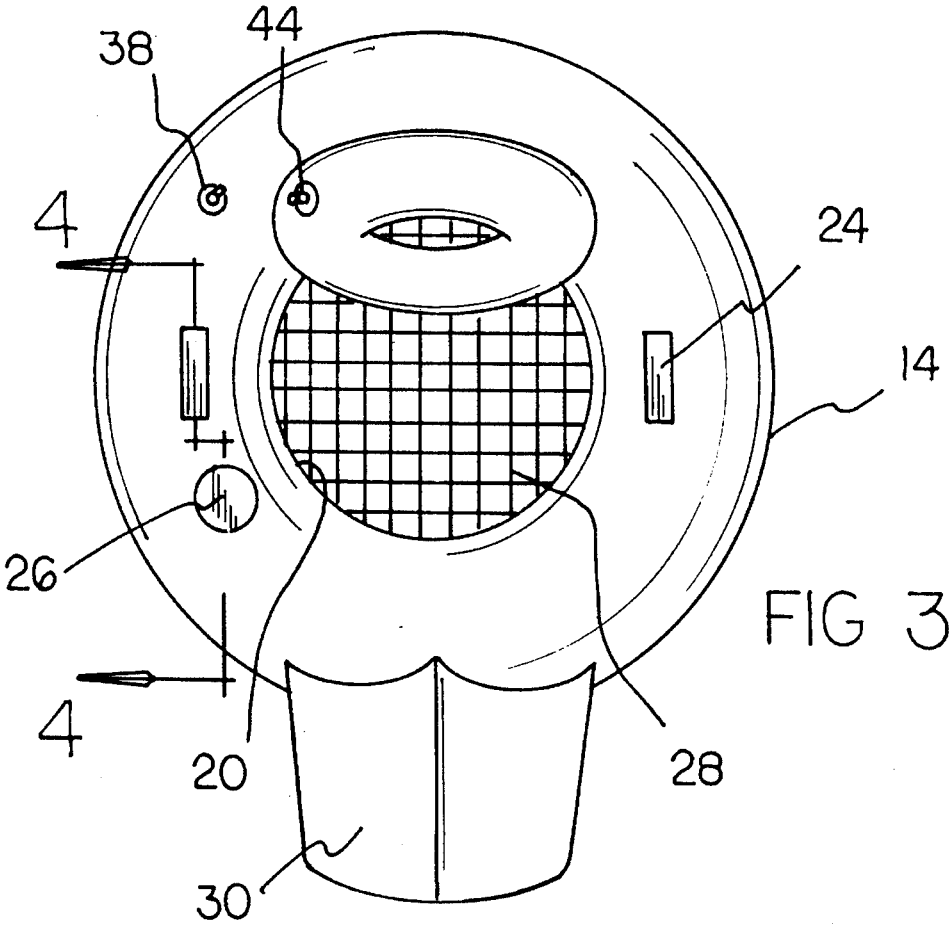
FIG. 3 is a plan view of the preferred embodiment of the present invention.
Figure 4:
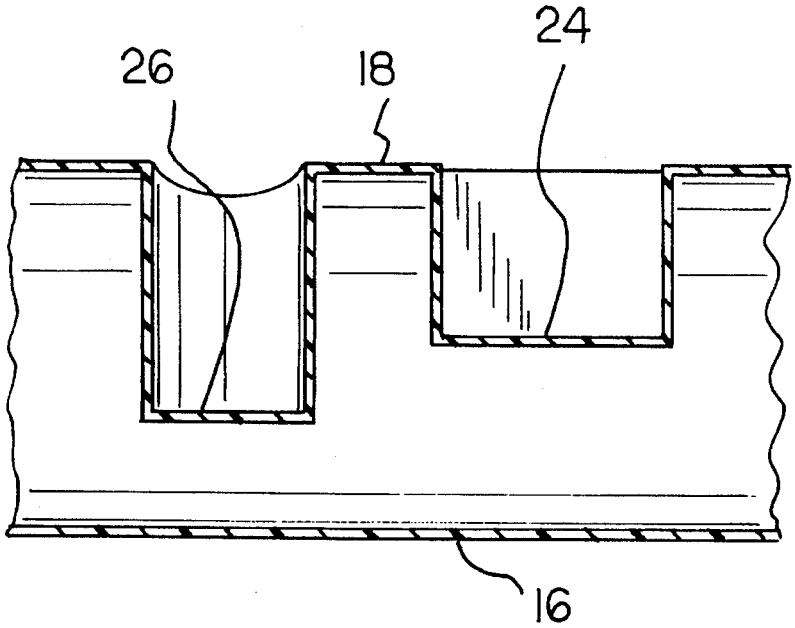
FIG. 4 is a cross-sectional view of the seat of the present invention taken along the line 4—4 of FIG. 3.
Figure 5:
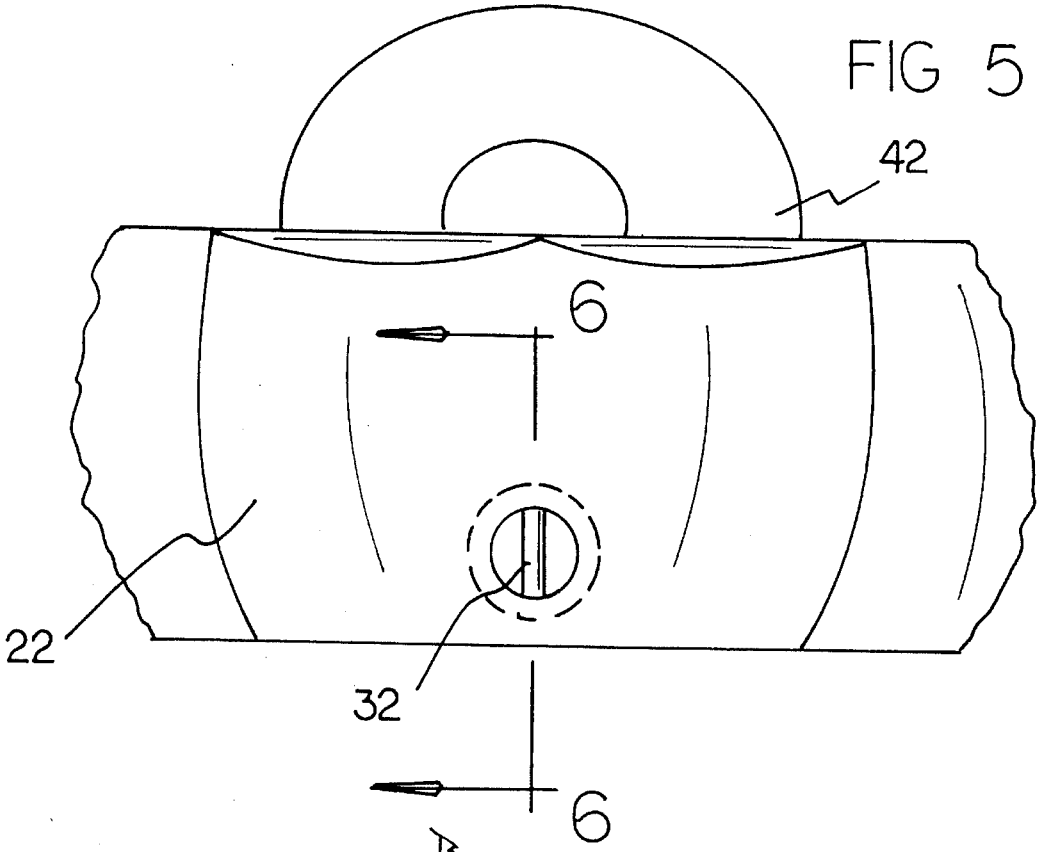
FIG. 5 is an enlarged side-elevational view of the leg rest of the present invention.
Figure 6:
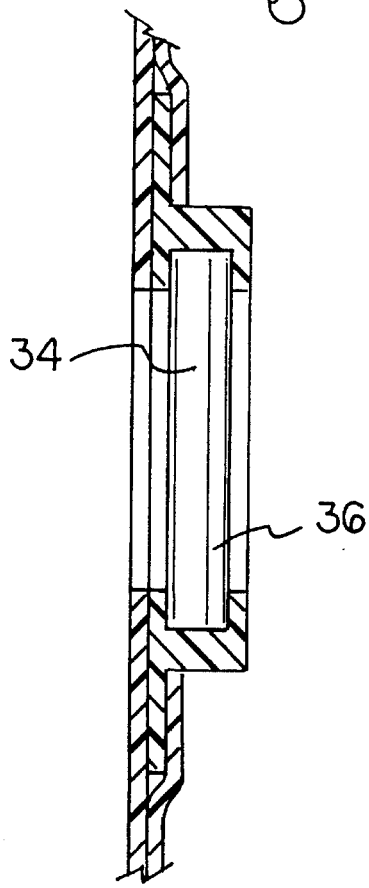
FIG. 6 is a cross-sectional view of the eye hook of the leg rest taken along the line 6—6 of FIG. 5.

With reference now to the drawings, and in particular, to FIG. 1 thereof, the preferred embodiment of the new and improved inflatable recreational inner tube toy embodying the principles and concepts of the present invention and generally designated by the reference number 10 will be described.

Specifically, the present invention essentially includes two major components. The major components are the seat and back rest. These components are interrelated to provide the intended function.

More specifically, it will be noted in the various Figures that the first major component is the seat 12. The seat is formed of a toroid-shaped inflatable primary tube 14. The primary tube is formed of a flexible elastomeric material such as rubber. The primary tube has a bottom surface 16, a top surface 18, an inner periphery 20 defining and enclosing a hollow interior, and an outer periphery 221. The primary tube also has a pair of diametrically opposed sunken handles 24 integrally coupled to the top surface and positioned about the interior. The primary tube also includes a cup holder 26. The cup holder is formed as a generally cylindrical recess integrally coupled to the top surface near one, of the handles. The seat also includes a plurality of straps 28 extended across the interior in a matrix-type configuration. The straps are formed of nylon or other similar strong flexible material. The straps are coupled to the inner periphery at a location near the bottom surface. The straps in combination with the primary tube create a generally cup-shaped recess for holding a user. The seat also includes a generally duckbill-shaped inflatable leg rest. The leg rest is formed of a flexible elastomeric material such as rubber. The leg rest is integrally coupled to and extended outwards from the outer periphery of the primary tube. The leg rest includes an eye hook 32 formed thereon. The eye hook is formed of a rod 34 positioned within a generally circular recess 36. The eye hook allows attachment of an external pull rope for pulling the present invention with a boat, snowmobile, or the like. Lastly, a valve 38 is coupled to the primary tube. The valve allows the seat to be inflated and deflated.

The second major component is the back rest 40. The back rest is formed of a toroid-shaped inflatable secondary tube 42. The secondary tube is formed of a flexible elastomeric material such as rubber. The secondary tube has an outer diameter smaller than that of the primary tube. The back rest is coupled to the inner periphery of the primary tube within the recess and extended angularly upwards therefrom. The back rest is generally aligned with the leg rest such that the recess is positioned therebetween. The back rest further includes a valve 44 coupled thereto. The valve allows the back rest to be inflated and deflated.

The present invention can be used for sled riding in snow or can be pulled by a vehicle such as a snow mobile, a four-wheeler, or a ski boat. The present invention can also be used for floating down a river or for general play in a body of water. The present invention is made of rubber except the nylon straps used in forming the seat. The outer diameter of the primary tube of the present invention is about 4 feet in length. The outer diameter of the back rest is about 18 inches in length. Thus, the ratio of the outer diameter of the back rest to the outer diameter of the seat is about 3:8. The bottom surface of the primary tube is formed of reinforced rubber with a thickness of about ⅜ inch. The eye hook is formed of a polyester cord reinforced lug or rod. The eye hook is reinforced to insure that it does not rip under high-loading conditions. The eye hook is located on the outboard end of the leg rest is such that the present invention will ride in a level orientation when pulled by a vehicle.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. An inflatable recreational inner tube toy for use in recreational activities comprising, in combination:

a seat further comprising a toroid-shaped inflatable rubber primary tube having an outer diameter, a bottom surface, a top surface, an inner periphery defining a hollow interior, an outer periphery, a pair of diametrically opposed sunken handles integrally coupled to the top surface, a cup holder formed as a recess integrally coupled to the top surface, a plurality of nylon straps extended across the interior in a matrix-type configuration and coupled to the inner periphery at a location near the bottom surface to create a generally cup-shaped recess for holding a user, a generally duckbill-shaped inflatable rubber leg rest integrally coupled to and extended outwards from the outer periphery of the primary tube with the leg rest including an eye hook disposed thereon for allowing attachment of an external pull rope and with the eye hook formed of a rod positioned across a generally circular recess, and a valve coupled to the primary tube for allowing the seat to be inflated and deflated; and a back rest formed of a toroid-shaped inflatable rubber secondary tube having an outer diameter and with the ratio of the outer diameter of the back rest to the outer diameter of the seat being about 3:8 and with the back rest coupled to the inner periphery of the primary tube and extended angularly upwards therefrom, the back rest further having a valve coupled thereto for allowing it to be inflated and deflated.

* * * * *